United States Patent [19]

Binder et al.

[11] Patent Number: 4,660,257

[45] Date of Patent: Apr. 28, 1987

[54] METHOD OF AND A CONTROL ARRANGEMENT FOR A MACHINE FOR EXTRACTING FIBER FLOCKS FROM TEXTILE FIBER BALES

[75] Inventors: Rolf Binder, Schottikon, Fed. Rep. of Germany; Daniel Hanselmann, Winterthur; Christoph Stäheli, Frauenfeld, both of Switzerland

[73] Assignee: Maschinenfabrik Rieter AG, Winterthur, Switzerland

[21] Appl. No.: 825,098

[22] Filed: Jan. 31, 1986

[30] Foreign Application Priority Data

Feb. 7, 1985 [CH] Switzerland ..... 00584/85

[51] Int. Cl.[4] ..... D01G 13/00

[52] U.S. Cl. ..... 19/80 R; 19/81; 19/300

[58] Field of Search ..... 19/80 R, 81, 145.5, 19/300

[56] References Cited

U.S. PATENT DOCUMENTS 4,107,820 8/1978 Mahrt et al. ..... 19/145.5 X
4,297,766 11/1981 Trutzschler ..... 19/80 R
4,382,316 5/1983 Goldammer et al. ..... 19/145.5 X
4,493,131 1/1985 Dragagna et al. ..... 19/80 R

*Primary Examiner*—Louis K. Rimrodt
*Attorney, Agent, or Firm*—Michael J. Striker

[57] ABSTRACT

In order to extract fiber flocks from individual textile fiber bale groups with a substantially constant extraction power independently of density variation distribution over the bale height, the individual bale groups are subdivided into a plurality of height zones exhibiting different densities of fiber material. Then, an extracting member provided with a rotating extraction head is moved through the upper zone with a relatively large penetration depth, while the penetration depth is gradually reduced during the movement of the extracting member through the next lower zone until the penetration depth desired for the next following lower zone is reached, from which point this penetration depth is maintained until reaching the lowermost zone during the movement through which the penetration depth is again gradually increased until the last layer to be extracted is reached. A control system for performing the above method includes a microprocessor which stores the inputted desired number of passes and penetration depths for the definition of the zones, and controls the movement of the extraction member accordingly.

8 Claims, 1 Drawing Figure

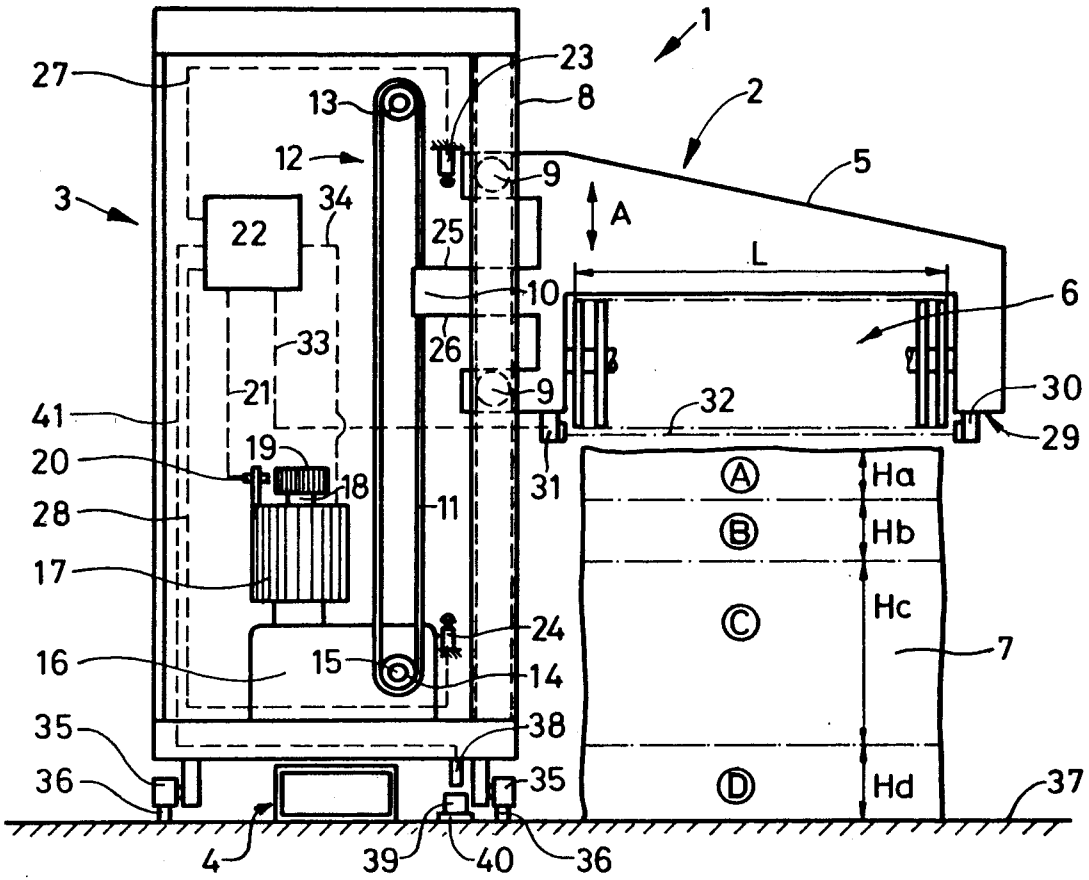
1
2
3
4
5
6
7
8
9
10
11
12
13
14
15
16
17
18
19
20
21
22
23
24
25
26
27
28
29
30
31
32
33
34
35
36
37
38
39
40
41
A
L
Ha
Hb
Hc
Hd
Ⓐ
Ⓑ
Ⓒ
Ⓓ

METHOD OF AND A CONTROL ARRANGEMENT FOR A MACHINE FOR EXTRACTING FIBER FLOCKS FROM TEXTILE FIBER BALES

BACKGROUND OF THE INVENTION

The present invention relates to a method of extracting fiber flocks from textile fiber bales, and to a control arrangement for controlling the operation of a machine which performs such extraction.

There are already known various methods of extracting fiber flocks from textile fiber bales by means of an extracting member movable in a plurality of passes over and lowerable onto the bales to extract the fiber flocks from the upper bale surfaces with a penetration depth into the bales that is variably dependent on the bale height and to deliver the extracted fiber flocks to a flock transportation means, as well as arrangements for controlling the operation of correspondingly constructed machines for extracting fiber flocks from textile fiber bales. A machine of this kind typically includes a reciprocating raising and lowering device movable back and forth along the bales, and an extracting member mounted on the reciprocating device for up and down movement therewith and including a rotatable extracting roller operative to deliver fiber flocks extracted from the bales to flock transportation means.

A control arrangement of the above type is disclosed, for instance, in the German published patent application DT-OS No. 32 45 506. The machine controlled by this control arrangement travels back and forth along a straight-line trajectory above a group of textile fiber bales and, in the course of such movement, a rotating extraction roller mounted on the machine extracts fiber flocks from the bales. The extracting roller can penetrate into the surface region of the respective bale with a varying force which can be adjusted to take into account the varying bale heights and thus the varying bale densities. For this purpose, there are provided three switches which are arranged with adjustable mutual spacing along a vertical line. During the processing of the bales, these switches are sequentially operated as the extraction member is lowered. Each of the switches controls a pneumatic switching valve which opens the path for the flow of pressurized air at a predetermined pressure into a pressure air cylinder-and-piston unit. The piston rod of this unit is connected to a middle portion of a length of cable. The cable length passes, to either side of this middle portion, around respective guide rollers. The extraction member is connected to a cable end portion which depends from one of the guide rollers, while a counterweight which compensates for the weight of the extraction member is secured to the other end portion of the cable.

An important disadvantage of this particular construction of the above-mentioned arrangement is that the cable can not exert pressure on the extraction member and thus on the bale. Accordingly, this publication merely teaches the control of the pressure of the extraction member on the bale surface by means of switches and the associated supply of pressurized air to the pressure cylinder-and-piston unit, with a varying pressure depending on the bale height.

In use of this particular control system, the extraction member extracts flocks from the uppermost bale layer with a predetermined constant pressure which is controlled by the upper switch, until the middle bale layer is reached. At the beginning of extraction of fiber flocks from this middle layer, the middle one of the switches causes the pressure delivered to the pressure cylinder-and-piston unit to rise relatively to the pressure supplied to the cylinder-and-piston unit previously, for processing the middle layer. Finally, when the lower bale layer is reached, the lower switch causes a constant pressure that is lower than that used before to be delivered to the cylinder-and-piston unit for the processing of the lower bale layer.

One disadvantage of this control system is that, upon transfer from one layer to the next, the effective pressure is changed in a stepwise manner, which results in a correspondingly stepwise variation of the processing performance. Another disadvantage of this approach is that only one bale group, with all of the bales of this group being of the same height, can be processed; otherwise, the switch positions would have to be constantly adapted to the changing bale heights.

SUMMARY OF THE INVENTION

Accordingly, it is a general object of the present invention to avoid the disadvantages of the prior art.

More particularly, it is an object of the present invention to provide a method of extracting fiber flocks from fiber flock bales, which method does not possess the disadvantages of the known methods of this kind.

Still another object of the present invention is so to develop the method of the type here under consideration as to be able to adapt the extraction height to the changing parameters of the extracted fibers.

It is yet another object of the present invention to devise a control arrangement for a machine for extracting fiber flocks from textile fiber bales, which arrangement is particularly suited for the performance of the method of the above kind.

A concomitant object of the present invention is so to construct the arrangement of the above type as to be relatively simple in construction, inexpensive to manufacture, easy to use, and reliable in operation nevertheless.

In pursuance of these objects and others which will become apparent hereafter, one feature of the present invention resides in a method of extracting fiber flocks from textile fiber bales by means of an extracting member movable in a plurality of passes over and lowerable onto the bales to extract the fiber flocks from the upper bale surfaces with a penetration depth into the bales that is variably dependent on the bale height and to deliver the extracted fiber flocks to a flock transportation means, which method comprises the steps of gradually reducing the penetration depth of the extraction member in an upper bale region during a predetermined number of passes from a predetermined maximum value to a lesser penetration depth value predetermined for a middle bale region; maintaining the penetration depth constant at the lesser penetration depth value while operating in the middle bale region; and again gradually increasing the penetration depth while operating in a lower bale region during a predetermined number of passes from the lesser penetration depth value to a maximum penetration depth which is predetermined for the increasing step.

Another concept of the present invention resides in an arrangement for controlling the operation of a machine for extracting fiber flocks from textile fiber bales, which machine includes a reciprocating raising and lowering device movable back and forth along the bales, and an extracting member mounted on the reciprocating device for up and down movement therewith and including a rotatable extracting roller operative to deliver fiber flocks extracted from the bales to flock transportation means, comprising pulse generator means mounted on the reciprocating device and operative for issuing position signals during the up and down movement of the extracting member to indicate the instantaneous position of the extracting member; switch elements operative for issuing respective limiting signals when the extracting member has respectively reached its upper and lower end position; means for inputting information concerning the desired penetration depth and number of passes of the extracting member; means connected to the pulse generator means, switch elements and inputting means and operative for automatically calculating from the position and limiting signals and from the information a reduction in the penetration depth during operation in an upper bale region, a required penetration depth during operation in a middle bale region, and an increase in the penetration depth during operation in a lower bale region, as well as the respective heights of the bale regions; and means for controlling the movement of the extracting member in dependence on the calculated values.

A particular advantage of the method and arrangement of the present invention, in addition to mitigating the above-mentioned disadvantages, is that adjustments of the processing or penetration depth can be carried out very quickly and simply by using a microprocessor or a similar device.

The novel features which are considered as characteristic of the invention are set forth in particular in the appended claims. The improved flock extraction machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The sole FIGURE of the drawing is a somewhat diagrammatic partially sectioned side elevational view of a bale opening and flock extracting machine equipped with a control system according to the present invention.

DETAILED DESCRIPTION OF THE PREFERRED EMBODIMENT

Referring now to the drawing in detail, it may be seen that the reference numeral 1 has been used therein to identify a machine for extracting textile fiber flocks. The machine 1 comprises an extraction member 2, a machine frame 3 and flock transport means 4. The extraction member 2 comprises a housing structure 5 in which a driven extraction roller 6 is supported for rotation. Flocks extracted from bales 7 by the extraction roller 6 are taken up by this housing 5 and transported in a non-illustrated manner into the flock transport means 4.

The housing 5 is movable up and down in the direction of an arrow A, in that pairs of rollers 9 which are rotatably mounted on the housing 5 are guided in guide rails 8 of the machine frame 3. However, in the sole FIGURE, only one of the roller pairs 9 and only one of the rails 8 is shown; the rollers 9 and the rail 8 provided in a similar manner on the opposite side are not visible. Further, the housing 5 comprises an engaging member 10 which is fixedly secured to a chain 11 of a chain drive 12.

The chain drive 12 further comprises a rotatably supported upper sprocket 13 for the reversal in direction of movement of the chain 11 and a lower sprocket 14 to drive this chain 11. The lower sprocket 14 is fixedly secured to a drive shaft 15 of a gear transmission 16. An electric motor 17 connected to the gear transmission 16 serves as an energy source and is formed as a step motor. The chain drive 12, the gear transmission 16 and the motor 17 are collectively referred to as the reciprocating mechanism.

A gear wheel 19 is secured to an upper end 18 of the shaft of the motor 17, as seen in the direction of the view of the sole FIGURE, for joint rotation therewith. The gear wheel 19 operates, together with a sensor 20, as a pulse generator, the pulse output of which is fed via a lead 21 to a microprocessor 22. The sensor 20 is of any commercially available type and produces a pulse each time it is passed by a tooth of the gear wheel 19. The sensor 20 is fixedly mounted.

An upper end-switch 23 and a lower end-switch 24 are provided for sensing the upper and lower end positions, respectively, of the extraction member 2 on the machine frame 3. The upper end-switch 23 is operated by an upper surface 25 on the engaging member 10, and the lower end-switch 24 is operated by a lower surface 26 on the engaging member 10. The upper end-switch 23 supplies its output to the microprocessor 22 via a lead 28.

Furthermore, an optical device comprising an emitter 30 and a receiver 31 is provided on a lower side 29 of the housing 5 facing the bales 7. The optical device 30 and 31 is so arranged that the emitter 30 generates a light beam 32 passing at least over the entire length L of the extraction roller 6; its light beam 32 is converted in the receiver 31 into a signal supplied via a lead 33 to the microprocessor 22. A further lead 34 connects the motor 17 with the microprocessor 22.

Finally, the machine frame 3 is arranged to travel in a direction (not shown) along the bales 7 and above the flock transport means 4; this movement is enabled by wheels 35 drivably secured to the frame 3 and resting on rails 36 which are secured to a floor 37 of the spinning mill.

In operation, the bales 7 are arranged in groups (not shown) in a known manner. The groups are such that bales 7 of substantially the same height are arranged together, and a spacing of 1.2 to 1.5 meters in maintained between the bale groups. A locating means is provided for locating the machine frame 3 in the end positions and in the positions between the respective individual bale groups. The locating means comprises, on the one hand, a sensor 38 on the underside of the machine frame 3 and, on the other hand, so-called positioning elements 39 disposed along the whole length through which the machine 1 is movable. The positioning elements 39 can be adjustably positioned on a rail 40. The presence of the positioning elements 39 is detected by the sensor 38 and indicated to the microprocessor 22 via a lead 41.

The above mentioned expression "end positions" refers, on the one hand, to the starting position of the machine 1 at the start of the rails 36, from which the movement of the machine 1 begins, and on the other hand, to the finish position at which the machine 1 changes its direction of travel.

The locating of the positioning elements 39 is carried out in such a manner that the machine 1 is brought to a stop in such a position that the extraction member 2 is located before the first of, or behind the last of, or between, the individual bale groups.

In order to process the bale 7 with a penetration depth adaptable in dependence upon the density, with substantially constant extraction power input, the bale height is divided into three or four zones. In the illustrated example, there are four such zones indicated respectively with the letters A, B, C and D.

Having so described the construction of the arrangement of the present invention, its operation will now be explained, still with reference to the drawing.

The extraction operation begins in the following manner: Before the first extraction step, the extraction member 2 moves through the distance from the upper end switch 23 to the lower end switch 24. In the course of this movement, the microprocessor 22 counts the pulses emitted by the sensor 20 in response to the gear wheel 19, and registers the sum of these pulses, that is, the spacing between the upper and lower end positions.

Thereafter, the microprocessor 22 must be programmed in the following manner for the extraction operation: First, two items of data are entered into the microprocessor 22, namely the penetration depth per pass of the extraction member 2 over the bale groups, this penetration depth being preset for the zone A, and the number of passes which are to be carried out with this penetration depth; this gives the height Ha. Then, the number of passes for the zone B is entered. Penetration depth for the zone B is calculated by the microprocessor 22. It is reduced in a stepwise manner during the entered number of passes, namely from the penetration depth for the zone A to the penetration depth of the zone C. The height Hb is derived from the calculation of the microprocessor 22. Thereafter, the penetration depth for the zone C is entered.

In a modification, in place of the penetration depth per pass for the zone C, the weight of the complete bale layout and the desired production rate per hour can be entered. Using these two items of data and the bale height, the microprocessor 22 calculates the penetration depth for all bale groups in such a manner that processing of all of them is completed simultaneously.

As a last step, the penetration depth of the last pass, and the number of passes for the zone D, are entered. During these passes, the penetration depth is increased stepwise from the penetration depth of the zone C to the penetration depth of the final pass. From this, the microprocessor 22 calculates the height Hd of the zone D, and thus the start of the penetration depth which rises again in this zone. The height Hc of the zone C is derived from the total height minus the heights Ha, Hb and Hd.

After the previously mentioned programming steps, the machine can be caused to start processing through manual operation of a start button (not shown) by an attendant. With the extracting member 2 in the upper end position (upon operation of the upper end switch 23), the machine 1 travels out of the starting position on the rails 36 above the bales 7 laid out on the floor 37. After passing over the first positioning element 39, which is indicated by the sensor 38, the machine continues to move for several seconds so that the extracting member 2 is located above the bale group. Thereafter, the extracting member 2 is lowered in response to a control command of the microprocessor 22 issued via the lead 34 to the motor 17. The lowering of the extracting member 2 continues until the light beam 32 is interrupted by the bale group. Due to the lowering until interruption of the light beam 32, the pulses caused by the gear wheel 19 are continually subtracted in the microprocessor 22 from the pulse total, so that, when the extraction member 2 stops as a result of interruption of the light beam 32, the height of this bale group is established.

If additional bale groups are present, the machine 1 travels automatically until detection of the next positioning element 39. Thereupon, the machine 1 stops in a similar manner and the extraction member 2 returns to the upper end position. After the machine 1 has travelled so far past the last-mentioned positioning element 39 that the extraction member 2 is again located above the bale group, the height of this bale group is established again in the previously described manner. The same procedure is carried out for each additional bale group.

After establishment of all bale group heights, the extracting member 2 is lowered before each pass over a bale group, for the extraction of flocks from the bale surfaces, through the penetration depth interval entered into the microprocessor or calculated thereby. The penetration depth can be different for each bale group, corresponding to the respective bale height. Switching of the penetration depth for processing of one bale zone to the penetration depth for the next bale zone is carried out automatically by the microprocessor 22. The penetration depths and the passes, and thus the zone heights, can be varied at any time without interruption of the extraction process.

It will be understood that each of the elements described above, or two or more together, may also find a useful application in other types of arrangements differing from the type described above.

While the invention has been illustrated and described as embodied in a method of extracting fiber flock from textile fiber bales, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. A method of extracting fiber flocks from textile fiber bales by means of an extracting member movable in a plurality of passes over and lowerable onto the bales to extract the fiber flocks from the upper bale surfaces with a penetration depth into the bales that is variably dependent on the bale height and to deliver the extracted fiber flocks to a flock transportation means, comprising the steps of initially lowering the extracting member in discrete increments having magnitudes determined by gradually reducing the penetration depth of the extraction member from one of the passes to the next while operating in an upper bale region during a predetermined number of passes from a predetermined maximum value to a lesser penetration depth value predetermined for a middle bale region; subsequently lowering the extracting member in discrete increments having magnitudes determined by maintaining said penetration depth constant from one of the passes to the next at said lesser penetration depth value while operating in said middle bale region; and subsequently lowering the extracting member in discrete increments having magnitudes determined by gradually increasing said penetration depth from one of the passes to the next while operating in a lower bale region during a predetermined number of passes from said lesser penetration depth value to a maximum penetration depth which is predetermined for said lower bale region.

2. The method as defined in claim 1, and further wherein said initial lowering step includes keeping said penetration depth constant at said predetermined maximum value for a predetermined number of passes while operating in said upper bale region prior to said reducing step.

3. The method as defined in claim 1, wherein at least one of said gradually increasing and gradually decreasing is performed in a linear manner.

4. The method as defined in claim 1, wherein at least one of said gradually increasing and gradually decreasing is performed in accordance with a predetermined program.

5. A method of extracting fiber flocks from textile fiber bales by means of an extracting member movable in a plurality of passes over and lowerable onto the bales to extract the fiber flocks from the upper bale surfaces with a penetration depth into the bales that is variably dependent on the bale height and to deliver the extracted fiber flocks to a flock transportation means, comprising the steps of initially lowering the extracting member in discrete increments having magnitudes determined by gradually reducing the penetration depth of the extraction member from one of the passes to the next while operating in an upper bale region during a predetermined number of passes from a predetermined maximum value to a lesser penetration depth value predetermined for a middle bale region from the total bale layout and the desired hourly production rate; subsequently lowering the extracting member in discrete increments having magnitudes determined by maintaining said penetration depth constant from one of the passes to the next at said lesser penetration depth value while operating in said middle bale region; and subsequently lowering the extracting member in discrete increments having magnitudes determined by gradually increasing said penetration depth from one of the passes to the next while operating in a lower bale region during a predetermined number of passes from said lesser penetration depth value to a maximum penetration depth which is predetermined for said lower bale region.

6. The method as defined in claim 5, wherein at least one of said gradually increasing and gradually decreasing steps is performed in a linear manner.

7. The method as defined in claim 5, wherein at least one of said gradually increasing and gradually decreasing steps is performed in accordance with a predetermined program.

8. An arrangement for controlling the operation of a machine for extracting fiber flocks from textile fiber bales, which machine includes a reciprocating raising and lowering device movable back and forth along the bales, and an extracting member mounted on said reciprocating device for up and down movement therewith and includng a rotatable extraction roller operative to deliver fiber flocks extracted from the bales to a flock transportation means, comprising pulse generator means mounted on the reciprocating device and operative for issuing position signals during the up and down movement of the extracting member to indicate the instantaneous position of the extracting member; switch elements operative for issuing respective limiting signals when the extracting member has respectively reached its upper and lower end position; sensing means mounted on the extracting member for joint movement therewith and operative for issuing a contact signal when the extracting member reaches the bale surface during the down movement thereof; microprocessor means including means for storing predetermined data about the desired penetration depth and number of passes of the extracting member, means connected to said pulse generator means, switch elements, sensing means and storing means and operative for automatically calculating from said position limiting and sensing signals and from said predetermined data a reduction in the penetration depth for each pass during operation in an upper bale region, a required penetration depth for the desired extraction power for each pass during operation in a middle bale region, and an increase in said penetration depth for each pass during operation in a lower bale region and the respective heights of said bale regions; and means for lowering the extracting member during operation in said bale regions in discrete increments having magnitudes determined for each of said passes by the value calculated for the respective pass by said microprocessor means.

* * * * *